US011222598B2

(12) United States Patent
Kim et al.

(10) Patent No.: US 11,222,598 B2
(45) Date of Patent: Jan. 11, 2022

(54) DISPLAY DRIVING DEVICE CAPABLE OF REDUCING A CHIP AREA AND A DATA TRANSMISSION TIME AND DISPLAY DEVICE INCLUDING THE SAME

(71) Applicant: Silicon Works Co., Ltd., Daejeon (KR)

(72) Inventors: Won Kim, Daejeon (KR); Young Bok Kim, Daejeon (KR); Dong Ju Kim, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 16/953,968

(22) Filed: Nov. 20, 2020

(65) Prior Publication Data

US 2021/0158762 A1 May 27, 2021

(30) Foreign Application Priority Data

Nov. 22, 2019 (KR) ..... 10-2019-0151401

(51) Int. Cl.
*G09G 3/3275* (2016.01)

(52) U.S. Cl.
CPC ... *G09G 3/3275* (2013.01); *G09G 2310/0297* (2013.01); *G09G 2310/08* (2013.01)

(58) Field of Classification Search
None
See application file for complete search history.

(56) References Cited

U.S. PATENT DOCUMENTS

2017/0004776 A1* 1/2017 Park ..... G09G 3/3208
2017/0053598 A1* 2/2017 Kwon ..... G09G 3/2096
2020/0335045 A1* 10/2020 Jeong ..... G09G 3/3233
2020/0357338 A1* 11/2020 Lee ..... G09G 3/3233

FOREIGN PATENT DOCUMENTS

KR 20150074657 A 7/2015
KR 20160088972 A 7/2016
KR 20170003872 A 1/2017
KR 20180065678 A 6/2018
KR 20180078700 A 7/2018

* cited by examiner

*Primary Examiner* — Chad M Dicke
(74) *Attorney, Agent, or Firm* — Polsinelli PC

(57) ABSTRACT

The present disclosure discloses a display driving device capable of reducing a chip area and a data transmission time and a display device including the same. The display driving device includes a first source driver and a second source driver. Each of the first source driver and the second source driver may include a sensing circuit configured to sample and hold input signals of a multi-channel, a multiplexer configured to transmit the input signals held by the sensing circuit, an analog-to-digital converter configured to convert, into digital data, the input signals received from the multiplexer, and a transmission circuit configured to transmit the digital data to a timing controller through a bus lane. The sensing circuit of the second source driver may hold the input signals while the first source driver transmits the digital data.

13 Claims, 2 Drawing Sheets

DISPLAY DRIVING DEVICE CAPABLE OF REDUCING A CHIP AREA AND A DATA TRANSMISSION TIME AND DISPLAY DEVICE INCLUDING THE SAME

BACKGROUND

1. Technical Field

The present disclosure relates to a display device, and more particularly, to a display driving device capable of reducing an area and a data transmission time and a display device including the same.

2. Related Art

In general, a display device includes a display panel, a display driving device, a timing controller, etc.

The display driving device converts, into a source signal, digital video data provided by the timing controller, and provides the source signal to the display panel. The display driving device may include a source driver integrated in a chip form, and may include a plurality of source drivers by considering the size and resolution of the display panel.

Furthermore, the source drivers of the display driving device sense the pixel signals of a multi-channel, respectively, convert the pixel signals into digital data, and transmit the digital data through a bus lane.

The display driving device according to a conventional technology is operated with a conversion time and a transmission time separated.

First, in the conventional technology, a pixel signal is converted into digital data. The digital data is stored in a memory circuit. The digital data stored in the memory circuit is transmitted to the timing controller through the bus lane. In this case, the source drivers transmit the digital data to the timing controller in a time-division manner.

The conventional technology has a problem in that an area is increased because it requires memory circuits corresponding to "the number of channels*the number of bits" for storing the digital data of the multi-channel. Furthermore, the conventional technology has a problem in that a total transmission time is increased as much as "conversion time+the number of channels*transmission time" because it is operated with the conversion time and the transmission time separated.

SUMMARY

Various embodiments are directed to providing a display driving device capable of reducing an area and a data transmission time and a display device including the same.

In an embodiment, a display driving device may include a first source driver and a second source driver. Each of the first source driver and the second source driver may include a sensing circuit configured to sample and hold input signals of a multi-channel, a multiplexer configured to transmit the input signals held by the sensing circuit, an analog-to-digital converter configured to convert, into digital data, the input signals received from the multiplexer, and a transmission circuit configured to transmit the digital data to a timing controller through a bus lane. The sensing circuit of the second source driver may hold the input signals while the first source driver transmits the digital data.

In an embodiment, a display device may include a display panel and a first source driver, a second source driver, and a third source driver each configured to provide a source signal to the display panel and sense characteristics of the display panel. Each of the first source driver, the second source driver and the second source driver may include a sensing circuit configured to sample and hold input signals of a multi-channel coupled to the display panel, a multiplexer configured to transmit the input signals held by the sensing circuit, an analog-to-digital converter configured to convert, into digital data, the input signals received from the multiplexer, and a transmission circuit configured to transmit the digital data to a timing controller through a bus lane. While the first source driver transmits the digital data, the sensing circuit of each of the second source driver and the third source driver may hold the input signals.

In an embodiment, a display driving device may include a first source driver, including a sensing circuit configured to sample and hold input signals of a multi-channel, a multiplexer configured to transmit the input signals held by the sensing circuit in response to carry signals for the multi-channel, an analog-to-digital converter configured to convert, into digital data, the input signals received from the multiplexer, a transmission circuit configured to transmit the digital data to a timing controller through a bus lane, and a control circuit configured to generate the carry signals in response to a sampling signal provided by the timing controller and provide the carry signals to the multiplexer. While a second source driver transmits the digital data, the sensing circuit of the first source driver holds the input signals.

DETAILED DESCRIPTION

Figure 1:
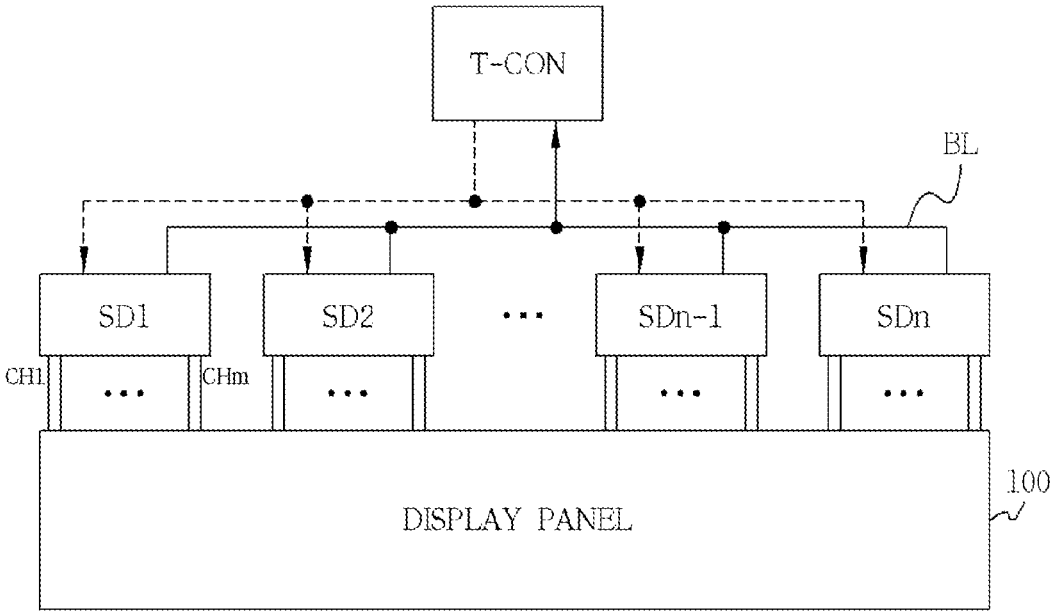
FIG. 1 is a block diagram of a display device according to an embodiment.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

Embodiments provide a display driving device capable of reducing a chip area and a data transmission time and a display device including the same.

In embodiments, a multi-channel CH1 to CHm may be defined as signal lines coupled to data lines or sensing lines of a display panel 100 in order to detect the pixel signals of the display panel 100. In this case, m is a natural number of 2 or more.

In embodiments, a sampling period may be defined as a period in which first to n-th source drivers SD1 to SDn sample and hold the pixel signals of the display panel 100 through the multi-channel CH1 to CHm. In this case, n is a natural number of 2 or more.

In embodiments, a converting and transmitting period may be defined as a period in which the first to n-th source drivers SD1 to SDn convert, into digital data, pixel signals held therein and transmit the digital data to a timing controller T-CON.

FIG. 1 is a block diagram of a display device according to an embodiment.

Referring to FIG. 1, the display device includes the timing controller T-CON, the display driving device including the first to n-th source drivers SD1 to SDn, and the display panel 100.

The timing controller T-CON provides digital video data to the first to n-th source drivers SD1 to SDn, and receives, from the first to n-th source drivers SD1 to SDn, digital data indicative of characteristics of the display panel 100.

The timing controller T-CON may generate compensation data for compensating for a characteristic deviation between pixels of the display panel 100 using the digital data received from the first to n-th source drivers SD1 to SDn, and may compensate for the digital video data using the compensation data.

The display panel 100 includes data lines (not illustrated) and gate lines (not illustrated), and has pixels formed at the intersections of the data lines and the gate lines. For example, the display panel 100 may be an organic light-emitting diode (OLED) panel.

Each of the pixels of the OLED panel may include an OLED and a driving transistor. The driving transistors and OLEDs of the pixels may be different in characteristics, such as a threshold voltage and mobility. If the driving transistors of the pixels have different characteristics, although the same source signal is applied to the pixels, currents provided by the driving transistors of the pixels to the OLEDs thereof may be different. Furthermore, in the OLED panel, the OLED and driving transistor of each pixel may be degraded according to a lapse of a driving time. Accordingly, a characteristic deviation may occur between the pixels.

The first to n-th source drivers SD1 to SDn receive digital video data from the timing controller T-CON, convert the digital video data into source signals, and provide the source signals to the display panel 100.

Furthermore, the first to n-th source drivers SD1 to SDn sense pixel signals from the display panel 100, convert the pixel signals into digital data, and provide the digital data to the timing controller T-CON through a bus lane BL. Such digital data may be used to compensate for a characteristic deviation between pixels.

The first to n-th source drivers SD1 to SDn may be coupled to the timing controller T-CON through the bus lane BL. Furthermore, the first to n-th source drivers SD1 to SDn may be coupled to the data lines or sensing lines of the display panel 100 through the multi-channel CH1 to CHm.

The present embodiments provide a display driving device including the first to n-th source drivers SD1 to SDn for detecting the input signals of the multi-channel CH1 to CHm of the display panel 100, converting the input signals into digital data, and providing the digital data to the timing controller T-CON so that characteristics of the display panel 100 is compensated for.

Furthermore, the present embodiments provide a display device capable of reducing an area and a data transmission time for the first to n-th source drivers SD1 to SDn.

Figure 2:
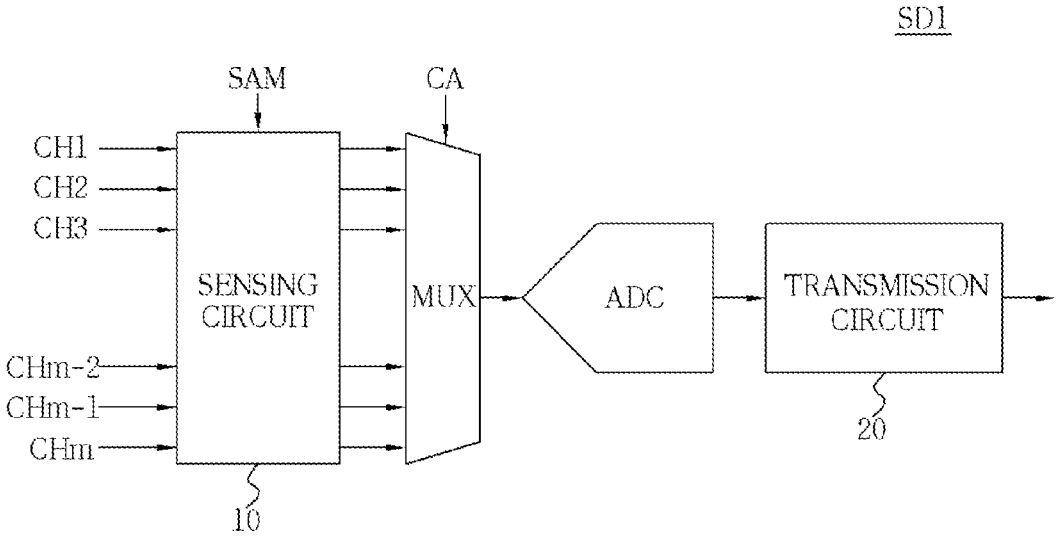
FIG. 2 is a block diagram of a first source driver of a display driving device according to an embodiment.

FIG. 2 is a block diagram of the first source driver SD1 of the display driving device according to an embodiment. In this document, a configuration of one first source driver SD1 is described for convenience of description. The first to n-th source drivers SD1 to SDn may have the same configuration.

Referring to FIGS. 1 and 2, the display driving device includes the first to n-th source drivers SD1 to SDn. Each of the first to n-th source drivers SD1 to SDn may include a sensing circuit 10, a multiplexer MUX, an analog-to-digital converter (ADC), and a transmission circuit 20.

The sensing circuit 10 may sample and hold the input signals of the multi-channel CH1 to CHm in response to a sampling signal SAM. For example, the sensing circuit 10 may include a sampling circuit (not illustrated) for sampling the input signals and a hold circuit for holding the input signals sampled by the sampling circuit. In this case, the sampling signal SAM may be provided by the timing controller T-CON. In this case, the multi-channel CH1 to CHm may be coupled to the data lines or sensing lines of the display panel 100 depending on the type of pixel.

The type of pixel may include a type in which a pixel signal is sensed through a data line to which a source signal is applied and a type in which a pixel signal is sensed through a separate sensing line.

The sensing circuit 10 may sense pixel signals as input signals through the multi-channel CH1 to CHm coupled to the data lines or sensing lines of the display panel 100 in response to the sampling signal SAM. Furthermore, the sensing circuit 10 may hold input signals while another source driver transmits digital data. For example, the sensing circuit 10 may hold input signals until carry signals CA of the multiplexer MUX to be described later are enabled.

The multiplexer MUX may transmit, to the ADC, the input signals held by the sensing circuit 10 in response to the carry signals CA. In this case, the carry signals CA may be enabled so that the input signals of the multi-channel CH1 to CHm are sequentially transmitted. In this case, the carry signals CA may be disabled while another source driver transmits digital data to the timing controller T-CON.

The ADC may convert, into digital data, the input signals received from the multiplexer MUX.

The transmission circuit 20 may transmit, to the timing controller T-CON, the digital data, received from the ADC, through the bus lane BL. In this case, while the ADC converts the input signals into the digital data, the transmission circuit 20 may transmit the digital data to the timing controller T-CON.

More specifically, the sensing circuit 10 of the n-th source driver SDn may hold input signals while an (n−1)-th source driver SDn−1 transmits digital data.

For example, while the first source driver SD1 transmits digital data, the sensing circuits of the second to n-th source drivers SD2 to SDn may hold input signals. Furthermore, while the second source driver SD2 transmits digital data, the sensing circuits of the third to n-th source drivers SD3 to SDn may hold the input signals.

Furthermore, when the (n−1)-th source driver SDn−1 completes the transmission of the digital data, the multiplexer MUX of the n-th source driver SDn may transmit the input signals of the multi-channel CH1 to CHm to the ADC.

For example, when the first source driver SD1 completes the transmission of the digital data, the multiplexer MUX of the second source driver SD2 may transmit the input signals of the multi-channel CH1 to CHm to the ADC. The ADC of the second source driver SD2 may convert the input signals into digital data. While the ADC of the second source driver SD2 converts the input signals into the digital data, the transmission circuit 20 of the second source driver SD2 may transmit the digital data to the timing controller T-CON.

As described above, the sensing circuit 10 of each of the second to n-th source drivers SD2 to SDn may hold input signals while the first source driver SD1 transmits digital data. When the first source driver SD1 completes the transmission of the digital data, the multiplexer MUX of the second source driver SD2 may transmit the input signals to the ADC. While the ADC of the second source driver SD2 converts the input signals into digital data, the transmission circuit 20 of the second source driver SD2 may transmit the digital data to the timing controller T-CON. In this case, the sensing circuit 10 of each of the third to n-th source drivers SD3 to SDn may hold the input signals while the second source driver SD2 transmits the digital data.

Likewise, while another source driver transmits digital data, each of the first to n-th source drivers SD1 to SDn may hold input signals using the hold function of the sensing circuit 10 thereof. While converting the input signals into digital data, each of the first to n-th source drivers SD1 to SDn may transmit the digital data to the timing controller T-CON through the bus lane BL.

Each of the first to n-th source drivers SD1 to SDn may further include a control circuit (not illustrated) for generating the carry signals CA for the multi-channel CH1 to CHm using the sampling signal SAM provided by the timing controller T-CON.

The sensing circuit 10 of each of the first to n-th source drivers SD1 to SDn may sample and hold the input signals of the multi-channel CH1 to CHm in response to the sampling signal SAM.

Furthermore, the multiplexer MUX of each of the first to n-th source drivers SD1 to SDn may transmit the input signals to the ADC thereof in response to the carry signals CA for the multi-channel CH1 to CHm.

For example, while the first source driver SD1 transmits digital data, the control circuit of the second source driver SD2 may disable the carry signals for the multi-channel CH1 to CHm of the second source driver SD2.

Furthermore, when the first source driver SD1 completes the transmission of the digital data, the control circuit of the second source driver SD2 may enable the carry signals for the multi-channel CH1 to CHm of the second source driver SD2 in preset order. In this case, the control circuit of the second source driver SD2 may sequentially enable the carry signals for the multi-channel CH1 to CHm.

Figure 3:
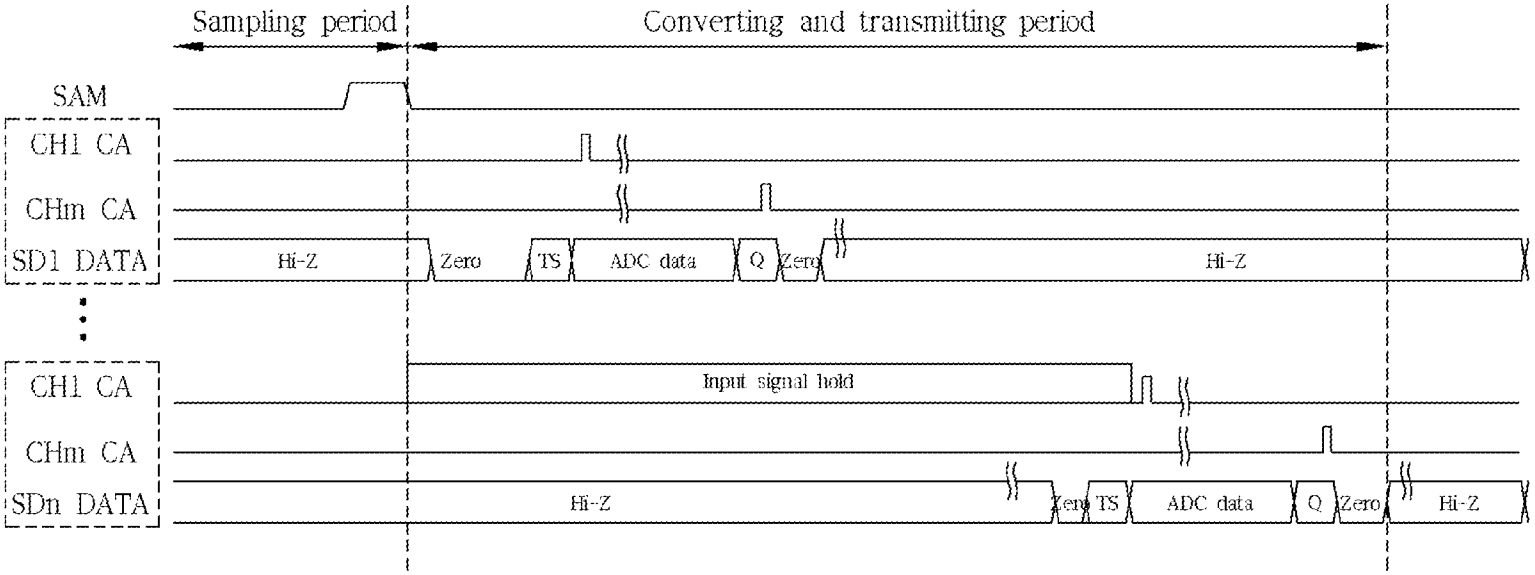
FIG. 3 is a timing diagram for describing an operation of the first source driver of FIG. 2.

FIG. 3 is a timing diagram for describing an operation of the first source driver SD1 of FIG. 2.

Referring to FIG. 3, in a sampling period, each of the first to n-th source drivers SD1 to SDn sample and hold the input signals of the multi-channel CH1 to CHm.

Next, in a converting and transmitting period, the first source driver SD1 converts the input signals of the multi-channel CH1 to CHm into digital data, and transmits the digital data to the timing controller T-CON. At this time, the second to n-th source drivers SD2 to SDn hold the input signals.

Next, in the converting and transmitting period, when the first source driver SD1 completes the transmission of the digital data, the second source driver SD2 converts the input signals of the multi-channel CH1 to CHm into digital data and transmits the digital data to the timing controller T-CON. At this time, the third to n-th source drivers SD3 to SDn hold the input signals.

Next, in the converting and transmitting period, when an (n−1)-th source driver SDn−1 completes the transmission of digital data, the n-th source driver SDn converts the input signals of the multi-channel CH1 to CHm into digital data and transmits the digital data to the timing controller T-CON.

Likewise, in the sampling period, each of the first to n-th source drivers SD1 to SDn detects and holds the input signals of the multi-channel CH1 to CHm. In the converting and transmitting period, while another source driver transmits digital data, each of the first to n-th source drivers SD1 to SDn holds the input signals of the multi-channel CH1 to CHm using the hold function of the sensing circuit 10 thereof. Furthermore, while converting the input signals into digital data, each of the first to n-th source drivers SD1 to SDn transmits the digital data to the timing controller T-CON.

As described above, embodiments can reduce a chip area by excluding a memory circuit using the hold function of the sensing circuit 10.

Furthermore, embodiments can reduce a total transmission time by transmitting digital data to the timing controller T-CON while converting the input signals of the multi-channel CH1 to CHm into the digital data.

As described above, embodiments can reduce a chip area by excluding a memory circuit using the hold function of the sensing circuit.

Furthermore, embodiments can reduce a total transmission time by transmitting digital data to the timing controller while converting the input signals of the multi-channel into the digital data.

While various embodiments have been described above, it will be understood to those skilled in the art that the embodiments described are by way of example only. Accordingly, the disclosure described herein should not be limited based on the described embodiments.

What is claimed is:

1. A display driving device comprising:

a first source driver and a second source driver, wherein each of the first source driver and the second source driver comprises:

a sensing circuit configured to sample and hold input signals of a multi-channel;

a multiplexer configured to transmit the input signals held by the sensing circuit in response to carry signals for the multi-channel;

an analog-to-digital converter configured to convert, into digital data, the input signals received from the multiplexer;

a transmission circuit configured to transmit the digital data to a timing controller through a bus lane; and wherein the sensing circuit of the second source driver holds the input signals while the first source driver transmits the digital data, and the control circuit of the second source driver disables the carry signals while the first source driver transmits the digital data.

2. The display driving device of claim 1, wherein when the first source driver completes the transmission of the digital data, the multiplexer of the second source driver transmits the input signals of the multi-channel to the analog-to-digital converter.

3. The display driving device of claim 2, wherein while the analog-to-digital converter converts the input signals into the digital data, the transmission circuit transmits the digital data to the timing controller.

4. The display driving device of claim 1, wherein the control circuit further configured to generate carry signals for the multi-channel in response to a sampling signal provided by the timing controller.

5. The display driving device of claim 4, wherein the sensing circuit of each of the first source driver and the second source driver samples and holds the input signals of the multi-channel in response to the sampling signal.

6. The display driving device of claim 4, wherein the multiplexer of each of the first source driver and the second source driver transmits the input signals to the analog-to-digital converter in response to the carry signals for the multi-channel.

7. The display driving device of claim 6, wherein when the first source driver completes the transmission of the digital data, the control circuit of the second source driver enables the carry signals for the multi-channel.

8. A display device comprising:

a display panel; and a first source driver, a second source driver, and a third source driver each configured to provide a source signal to the display panel and sense characteristics of the display panel, wherein each of the first source driver, the second source driver, and the third source driver comprises:

a sensing circuit configured to sample and hold input signals of a multi-channel coupled to the display panel;

a multiplexer configured to transmit the input signals held by the sensing circuit in response to carry signals for the multi-channel;

an analog-to-digital converter configured to convert, into digital data, the input signals received from the multiplexer;

a transmission circuit configured to transmit the digital data to a timing controller through a bus lane, and a control circuit configured to generate carry signals for the multi-channel, wherein while the first source driver transmits the digital data, the sensing circuit of each of the second source driver and the third source driver holds the input signals, and the control circuit of the second source driver disables the carry signals while the first source driver and the third source driver transmit the digital data.

9. The display device of claim 8, wherein when the first source driver completes the transmission of the digital data, the multiplexer of the second source driver transmits the input signals to the analog-to-digital converter, and the sensing circuit of the third source driver holds the input signals.

10. The display device of claim 9, wherein the transmission circuit transmits the digital data to the timing controller while the analog-to-digital converter converts the input signals into the digital data.

11. A display driving device comprising:

a first source driver, the first source driver comprising:

a sensing circuit configured to sample and hold input signals of a multi-channel;

a multiplexer configured to transmit the input signals held by the sensing circuit in response to carry signals for the multi-channel;

an analog-to-digital converter configured to convert, into digital data, the input signals received from the multiplexer;

a transmission circuit configured to transmit the digital data to a timing controller through a bus lane; and a control circuit configured to generate the carry signals in response to a sampling signal provided by the timing controller and provide the carry signals to the multiplexer, wherein while a second source driver transmits digital data, the sensing circuit of the first source driver holds the input signals, wherein the control circuit disables the carry signals while the second source driver transmits the digital data, and enables the carry signals when the second source driver completes the transmission of the digital data.

12. The display driving device of claim 11, wherein when the second source driver completes the transmission of the digital data, the multiplexer transmits the input signals of the multi-channel to the analog-to-digital converter in response to the carry signals.

13. The display driving device of claim 12, wherein while the analog-to-digital converter converts the input signals into the digital data, the transmission circuit transmits the digital data to the timing controller.

* * * * *